US005193519A

United States Patent [19]

Elliot

[11] Patent Number: 5,193,519

[45] Date of Patent: Mar. 16, 1993

[54] UNDERGROUND GALLERY SAW

[76] Inventor: David W. Elliot, P.O. Box 756, Bedford, Ind. 47421

[21] Appl. No.: 847,329

[22] Filed: Mar. 6, 1992

[51] Int. Cl.[5] ..... B28D 1/08

[52] U.S. Cl. ..... 125/21; 125/14

[58] Field of Search ..... 125/12, 13.03, 14, 17, 125/21, 36, 38; 299/15, 42, 47, 51-55, 72, 35, 73-76

[56] References Cited

U.S. PATENT DOCUMENTS

| | | | |
|---|---|---|---|
| 2,783,789 | 3/1957 | Konway | 125/14 |
| 3,311,415 | 3/1967 | Miller | 125/21 |
| 4,181,115 | 1/1980 | Weisner | 51/165.91 X |
| 4,310,198 | 1/1982 | Destree | 125/14 X |
| 4,572,303 | 2/1986 | Marechal | 299/55 X |
| 4,750,468 | 6/1988 | Micheletti | 125/21 |
| 4,899,720 | 2/1990 | Chiri et al. | 125/21 |
| 4,962,967 | 10/1990 | Hinkle | 125/13.01 X |

FOREIGN PATENT DOCUMENTS

| | | | |
|---|---|---|---|
| 1123858 | 11/1984 | U.S.S.R. | 125/12 |

OTHER PUBLICATIONS

Kerfer type HRU 1100 Underground Cutting Saw System, Etx. F. Perrier & Cie., undated.

Stone cutter type HSTK-60/Carrara system, Maschinenfabrik-Korfmann GmbH, Undated.

*Primary Examiner*—Bruce M. Kisliuk
*Assistant Examiner*—John A. Marlott
*Attorney, Agent, or Firm*—Scott R. Cox

[57] ABSTRACT

An improved underground gallery saw useful for the cutting of stone comprised of a supporting base, tracks for moving the supporting base along the stone to be cut, a saw unit raising and lowering system, a plate rotation and pivot system, a saw unit connected to the plate system and an electrical and hydraulic systems to support the operation of the other elements of the system.

20 Claims, 12 Drawing Sheets

UNDERGROUND GALLERY SAW

BACKGROUND OF INVENTION

1. Field of Invention

This invention relates to a stone-cutting equipment and, in particular, stone cutting equipment used in an underground quarry.

2. Prior Art

Cutting and removing stone from the ground, particularly from underground quarries, is a difficult and frequently slow task. There are various techniques and types of equipment used to remove large blocks of stone from quarries. One method for removing stone from a quarry is by wedging out the stone using mechanical means employing hydraulics and pneumatics. This method is crude, difficult, time-consuming, and does not result in a smooth-cut surface for the cut stone.

Another method using a wire saw is disclosed, for example, in U.S. Pat. Nos. 3,598,101 and 3,884,212. The wire saw includes an abrasive cutting element, sleeved over an endless flexible wire and a pressure molded-in-place resilient material surrounding the cable and providing a substantially uniform diameter for the endless cutting element. This saw is commonly used in stationery wire saw stands wherein the wire saw is engaged by two sheaves located on either side of the block of stone being sawed. To use such a wire saw when the stone is in place requires drilling into the stone through which the wire is threaded and then reattached. The use of a wire saw in a quarry application is difficult, time consuming and certainly not a preferred method.

A newer method for cutting stone uses a belt-configured saw comprised of a mainframe, a jib movably mounted to the mainframe, and a continuous flexible belt extending around and in-driven engagement with sheaves on the jib. The belt includes a plurality of spaced-apart, abrasive cutting strips extending across the top and sides of the belt. This belt-configured saw employs a grinding action rather than a cutting action to cut the stone. Examples of this belt-configured saw are disclosed, for example, in U.S. Pat. Nos. 4,962,967, 4,945,889, 4,603,678, and 4,181,115. While such saws are useful in cutting stone, they must be attached to a support system to be useful in gallery application.

A device currently in use for the cutting of stone in an underground quarry is a cutter Kerfer type HRU 1100 Underground Cutting Saw System manufactured by Etx. F. Perrier & Cie. It uses a diamond-cutting, 68-link chain which is supported by a hydraulic support structure. However, it is limited to use in underground galleries which are approximately 8 feet in height and approximately 23 feet in width. It is frequently impractical because of its relatively light structure, imprecise hydraulic systems used for movement of the cutting element, and awkward or bulky arrangement with the hydraulic plant and other controls maintained in a separate element, from the cutting element.

Another system similar to the Perrier system, manufactured by Maschinenfabrik Korfmann GMBH of Germany is a Korfman - Stone Cutter Type HSTK-60/Carrara system. Again, as with the Perrier device, it can only be used in chambers which are a maximum of 3 meters in height, 5 meters in width. Further, it can cut to a depth of no more than 2.5 meters. Similar problems are involved in the use of this system as with the Perrier system, including extensive set-up time and awkwardness of the equipment while in use.

There are a number of other devices that have been used for the cutting of very hard materials such as reinforced concrete, stone and the like. Although these tools are not normally used for the cutting of stone in a quarry, they do disclose methods for the cutting of hard materials. See, for example, U.S. Pat. Nos. 4,998,775, 4,986,252, 4,899,720, 4,836,494, 4,756,298, 4,181,115, 3,982,521, 3,722,497, 3,545,422, and 3,360,298.

Although many of the devices disclosed can in some circumstances cut stone from a quarry, none does so efficiently. Each has problems of set-up or use which make it impractical or time-consuming to use. Further, the area of the cut is severely limited.

Therefore, it is an object of this invention to provide a device for the cutting of stone from an underground gallery which permits the stone to be cut along an extended face without resetting of the equipment.

It is a still further object of this invention to provide a device for the cutting of stone from an underground gallery which is easy to set up and can continue to cut stone without extensive loss of time.

It is a still further object of this invention to provide a device for the cutting of stone from an underground gallery wherein the device can cut from the top of the ceiling to the bottom of the floor and from side-to-side along the face of the stone.

It is a still further object of this invention to provide a device containing a saw for the cutting of stone from an underground gallery wherein the device can cut up to at least about 20 feet in height with the depth of cut limited only by the size of the saw.

It is a still further object of this invention to provide a cutting device for the cutting of stone from an underground gallery wherein the cutting device can run on a track, providing virtually limitless travel length, thus reducing significantly set up time.

These and other objects and features of the present invention will become apparent to those skilled in the art from a consideration of the following detailed description, drawing and claims. The description, along with the accompanying drawings, provide a selected example of construction of the device to illustrate the invention.

SUMMARY OF INVENTION

In accordance with the present invention, there is provided an improved underground gallery saw system comprised of a support base, tracks for moving the support base along the stone to be cut, a saw unit raising and lowering system, a plate rotation and pivot system, a saw unit connected to the plate system, and electrical and hydraulic systems to support the operation of the other elements of the system.

This improved underground gallery saw permits the efficient cutting, both horizontally and vertically of stone in an underground quarry. The underground gallery saw is designed to run on a track while cutting stone from floor to ceiling. The saw allows rotation and pivoting of the blade of the saw permitting the cutting of blocks of stone at or near the ceiling of the gallery, down the entire face of the stone, and at or near the floor of the gallery. This saw cuts large stone blocks of sufficient size for economical quarrying. This underground gallery saw, by its unique design, is stable and operates without delays from constant set-up procedures as the stone is being cut and removed. This unique underground gallery saw saves a considerable amount of set-up time and permits the convenient and quick movement of the saw from one location to a new location for continued use.

BRIEF DESCRIPTION OF DRAWINGS

This invention will now be described with reference to the accompanying drawings in which.

DETAILED DESCRIPTION OF PREFERRED EMBODIMENT

Figure 1:
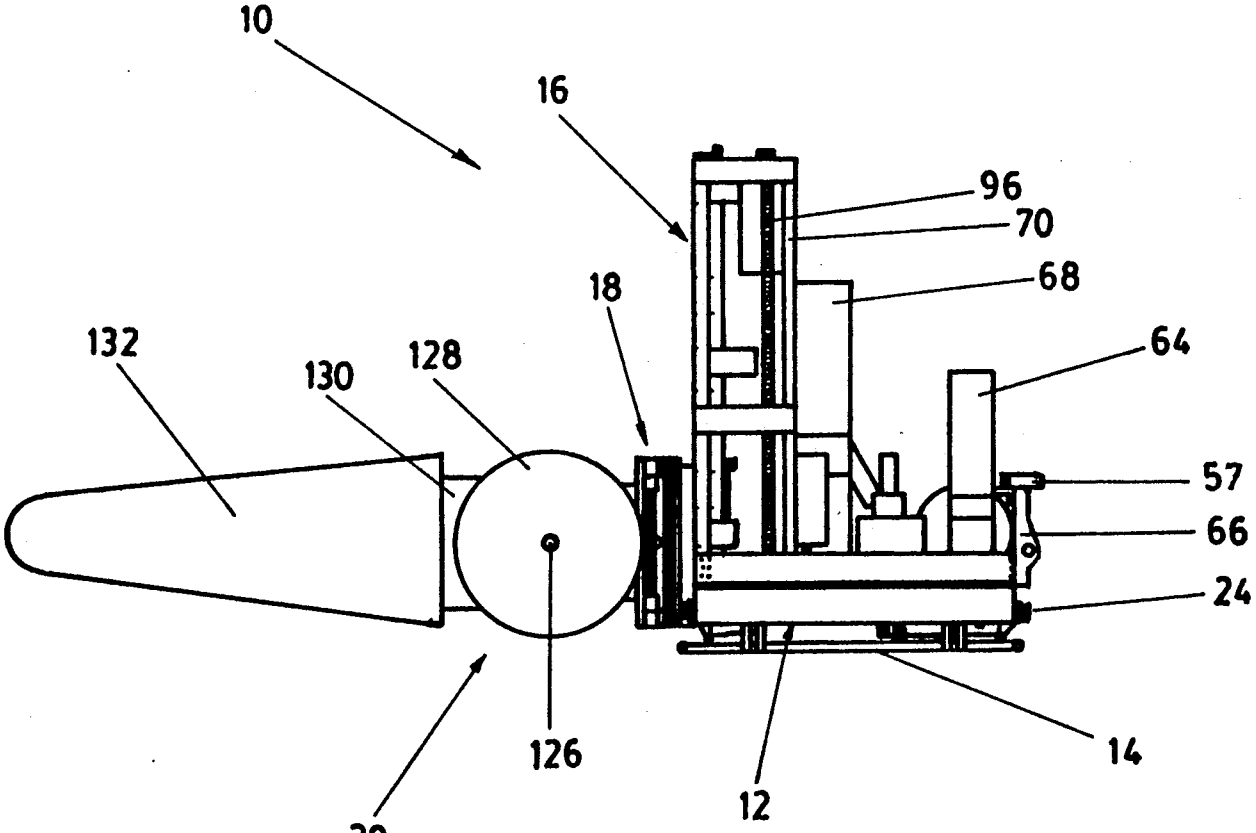
FIG. 1 is a side view of the saw system with the saw unit lowered and set for a vertical cut.
Figure 2:
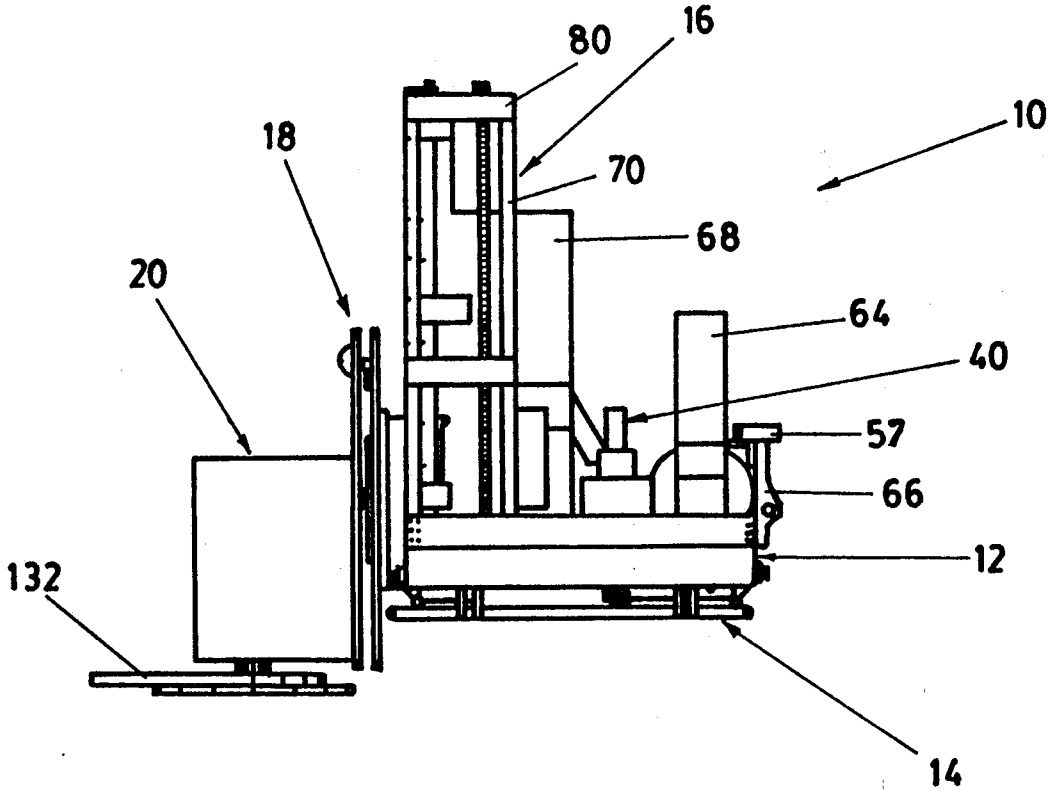
FIG. 2 is a side view of the saw system with the saw unit lowered and set for a horizontal cut.
Figure 3:
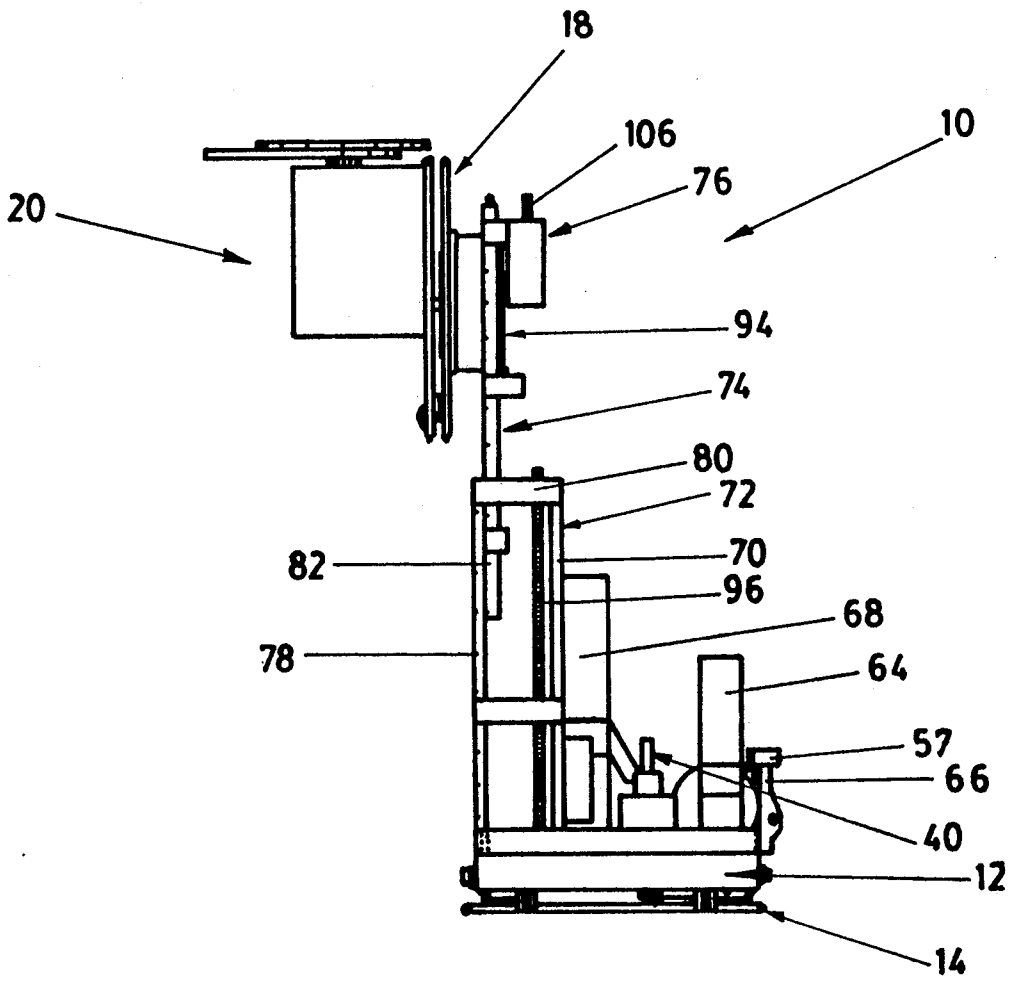
FIG. 3 is a side view of the saw system with the saw unit raised and set for a horizontal cut.

Although the invention is adaptable to a wide variety of uses, particularly for the cutting of stone or for use in mining or other underground applications, it is shown in the drawings for purpose of illustration as embodied in an improved underground gallery saw system (10) comprised of a support base (12) which runs on tracks (14) wherein said support base supports a saw unit raising and lowering system (16) to which is attached a plate rotation and pivot system (18) for pivoting and rotating a saw unit (20). See FIGS. 1, 2 and 3. Also attached to the support base as operational elements of the gallery saw system (10) are conventional electrical and hydraulic systems (not shown) for movement of the support base (12) on the tracks (14), raising and lowering of the saw unit raising and lowering system (16), pivoting and rotation of the plate rotation and pivot system (18), operation of the saw unit (20) and other monitoring and diagnostic systems which are conventional in the operation of the improved underground gallery saw system (10).

The improved underground gallery saw system (10) combines a number of conventional components with specially designed elements to produce an improved underground gallery saw system for use for the cutting of stone. Much of the electrical and hydraulic systems is conventional and is well known in the industry.

Figure 4:
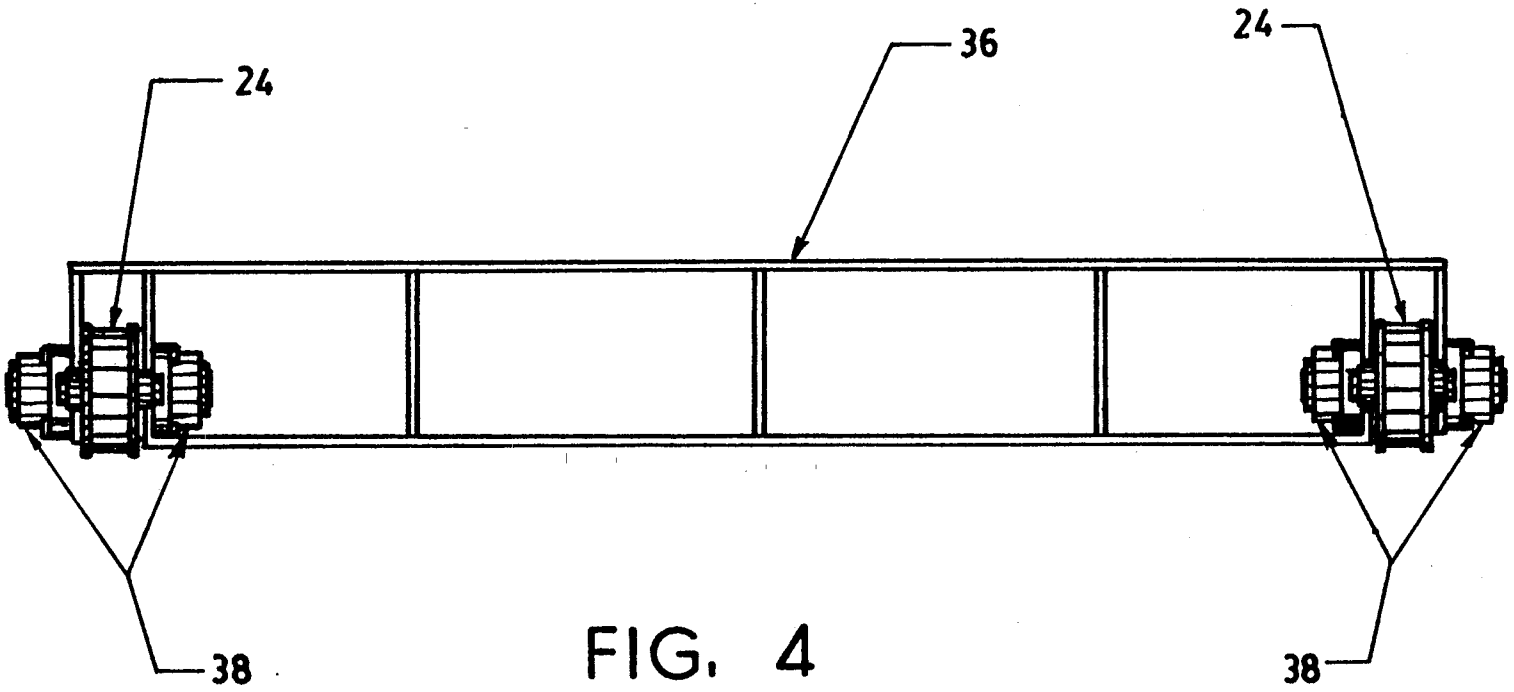
FIG. 4 is a side view of the end truck assembly showing the wheels for movement of the saw system on tracks.
Figure 6:
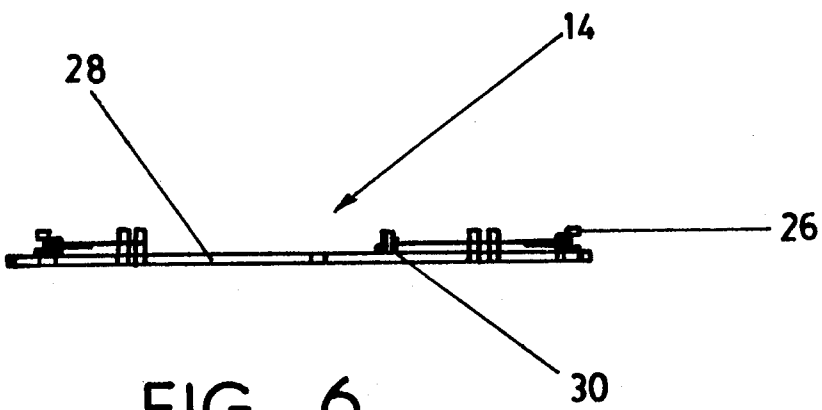
FIG. 6 is a side view of the track system.
Figure 5:
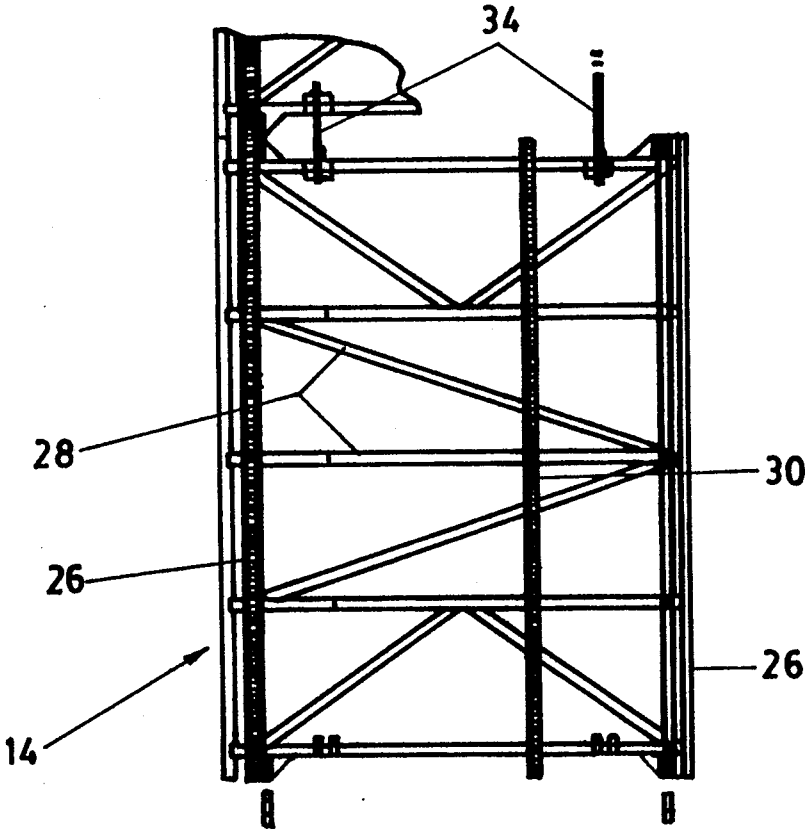
FIG. 5 is a top view of the track system.
Figure 7:
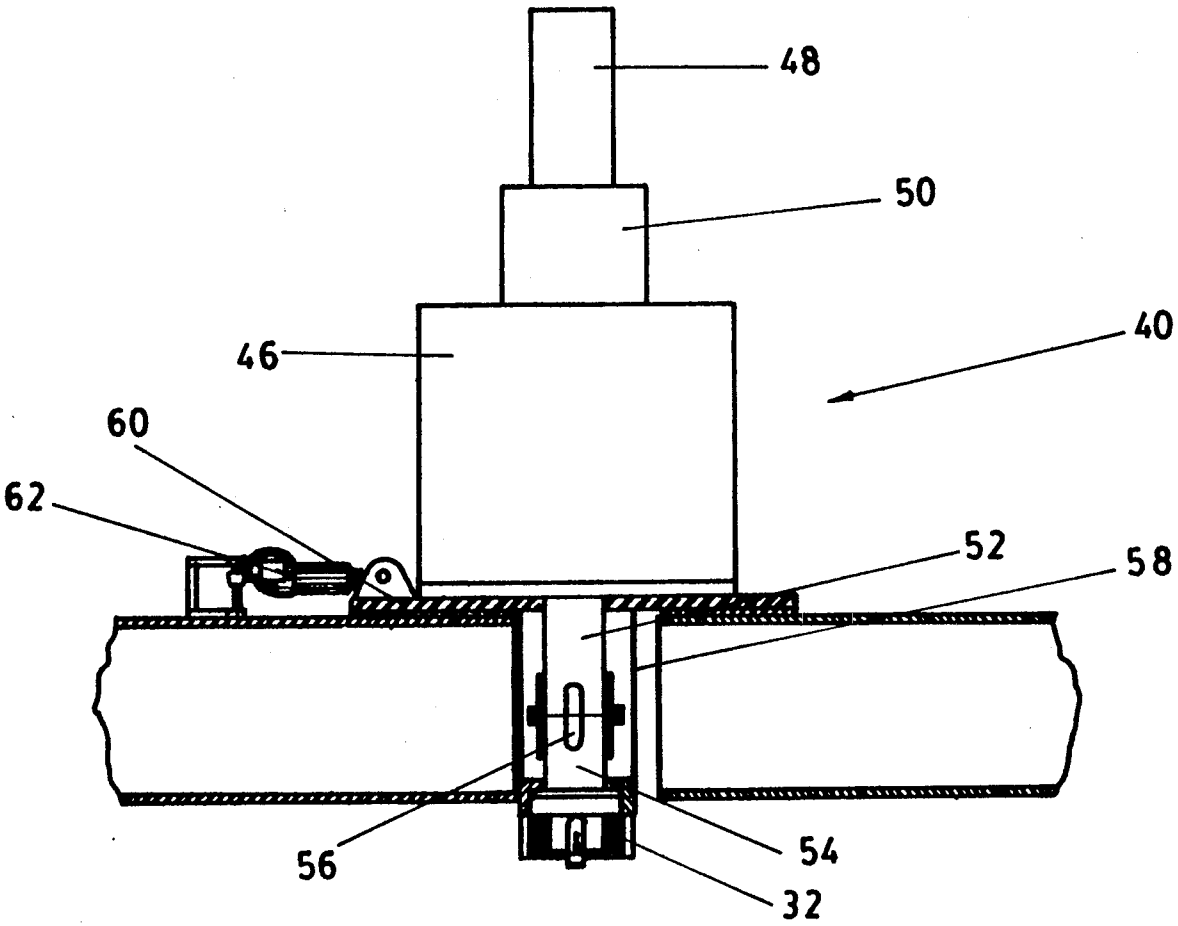
FIG. 7 is a side view saw gear box travel assembly which moves the saw system on the tracks.

The support base (12) contains 4 wheels (24) which run on the tracks (14) to move the gallery saw along the face of the wall to be cut. See FIG. 4. The tracks (14) are comprised of conventional I-shaped rails (26) secured together by metal support bars (28). See FIG. 5. There are two sets of rails on opposite sides of the tracks on which the wheels move. Although a number of systems could be used for moving the gallery saw system (10) on the tracks, the preferred method is by use of a rack gear system (30) secured to the support bars (28) of the tracks between the two rails. This rack gear (30) works in conjunction with a spur or pinion gear (32) (see FIG. 7) contained in the support base (12) to move the gallery saw system (10) along the track (14). The spur or pinion gear and its elements will be discussed in more detail in the discussion of the support base.

The rails (26) can be of various sizes or shape but preferably each rail is an I-shaped rail well known in the industry. The rack gear (30) is a conventional gear bar system manufactured, for example, by Browning. It is secured to the support bars by conventional securing means such as by being welded in place. The distance between the rails depends on the overall size of the support base, but preferably the rails will be from about 4 to about 15 feet apart. Larger or smaller distances can be used if greater or lesser support for the support base is required.

Sections of the track can be made and fit together by conventional track bolts (34) containing conventional pins and nuts. For example, it may be desired to cut a surface of a wall 30 or more feet across. For ease of usage, each section of track should be at least about 10 feet long and preferably 11–12 feet in length. Individual sections of track are then pinned together to cover the desired length of wall surface. See FIG. 5. Additional sections of tracking can be used with the only limitation being the length of the surface to be cut and the length of the electrical umbilical cords (not shown) which are attached to the underground gallery saw system (10).

The support base (12) for the improved underground gallery saw system (10) performs several important functions. The support base is comprised of two basic elements. The first of those elements is the end truck assembly (36), which is a self-contained structure which contains the wheels (24) which move on the rails of the track, bearings (38) for those wheels and a saw gear box travel assembly (40) which is used to move the system along the tracks. See FIGS. 4 and 7. Preferably, the end truck assembly (36) is comprised of two sections, a forward section containing two wheels and their bearings and a rear section which contains not only two wheels and their bearings but also the saw gear box travel assembly (40). If desired though not preferred the end truck assembly (36) can be constructed of a single section mainframe containing all four wheels (24), their bearings (38) and the saw gear box travel assembly (40).

Figure 8:
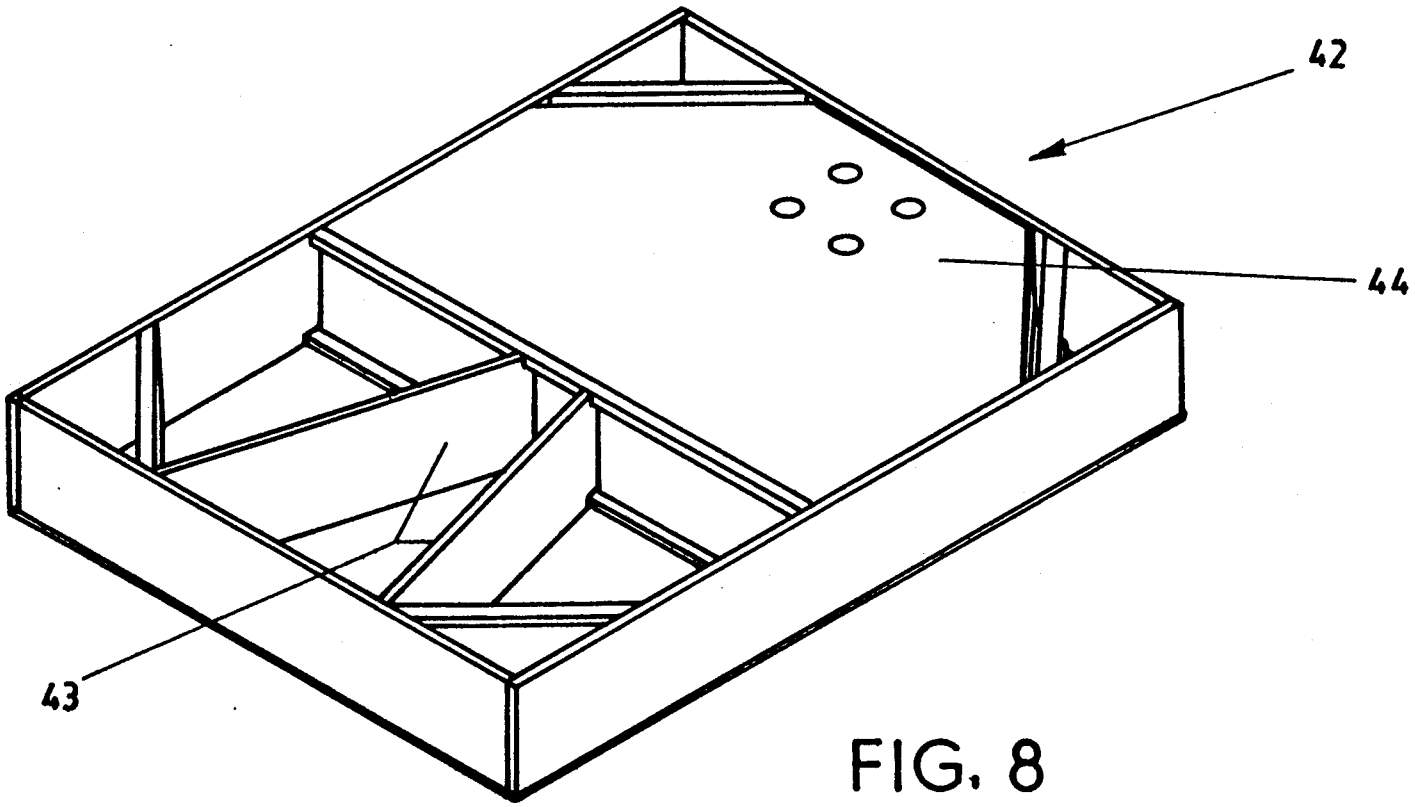
FIG. 8 is a perspective view of the support base structure.
Figure 9:
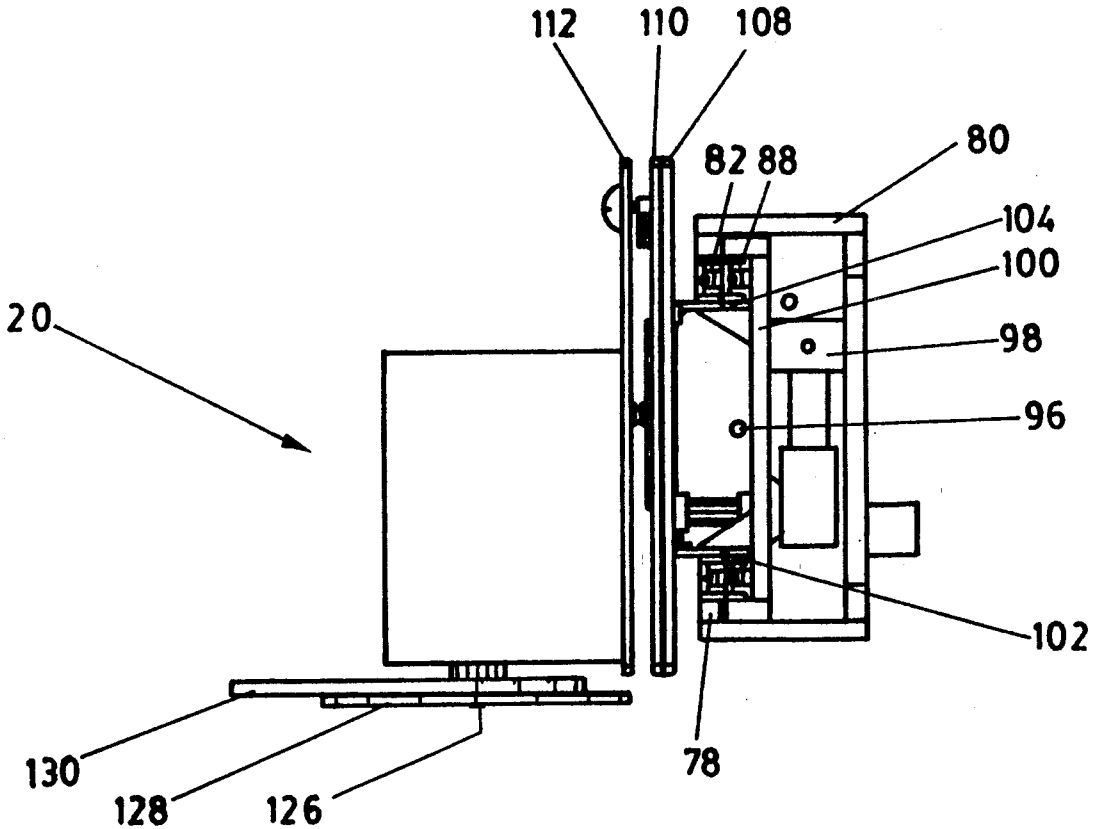
FIG. 9 is a top view of the saw system with the saw unit set for a vertical cut.

The second basic element of the support base is the support base frame structure (42). See FIG. 8. The support base frame structure (42) is of conventional metal construction with four sides supported by various support brackets (43). These brackets (43) for supporting a base are conventional and can be made of various well known sheet steel sections. As many of the operations of the system require either electrical or hydraulic systems and in many situations hydraulic power is preferred, the support base preferably also contains a reserve (44) for holding hydraulic fluid. The location of this hydraulic fluid reserve within the support base (12) also provides stability for the system by providing a counterbalance to the weight of some of the other elements of the system. For example, without a counterbalance, the raising and lowering of the saw unit might throw the entire system off balance. If hydraulic systems are not used on the gallery saw system (10), the support base frame structure (42) preferably contain other types of counterbalance which are well known in the industry.

The saw gear box travel assembly (40) operates the spur or pinion gear (32) to move the support base along the rack gear (30) of the tracks (14). The basic elements of the saw travel gear box assembly (40) include a gear box (46) with electric motor (48) and brake (50) which rotates the spur or pinion gear (32). See FIG. 7. Attached thereto is an output shaft (52) from the gear box (46) to a lower shaft (54) held in place by a rigid coupler (56) and bearings to keep the shaft stable and in line. On the end of the lower shaft is the spur or pinion gear (32) which meshes with the rack gear (30) of the tracks (14) to move the system along the tracks. In a preferred embodiment, the shaft of the electric motor of the gear box assembly is secured inside a tubing (58).

The saw travel gear box assembly (40) can be attached to the support base (12) by conventional means such as by securing it to a slide plate (60) which is welded or attached to the support base. Preferably, this slide plate is an abrasive resistant plate of sufficient strength to support the other elements of the system. The saw travel gear box assembly is thus secured to the surface of the support base. The movement of the spur or pinion gear (32) is controlled by a gear box assembly actuator (62) which permits the gear box assembly to be slid back and forth, thus coupling or decoupling the spur or pinion gear (32) from the rack gear (30). Decoupling of the spur gear (32) from the rack gear (30) permits easy engagement and disengagement for removing the entire assembly system from the tracks.

Also secured to the end truck assembly (36) are the wheels (24) which move on the rails of the track. See FIG. 4. Support for the wheels on the rails is provided by flange bearings (38), preferably of a Dodge type. There are preferably two bearings per wheel and with the preferable four wheels, a total of eight bearings. For each wheel, one bearing is mounted on the outside and one on the inside of the track. The wheels are made from hardened steel and preferably machined to a slight taper to assist in the tracking of the system movement on the track.

Secured to the back portion of the support base, preferably, is an element of a system to remove the saw system from the tracks. Many such systems exist, any of which may be used which permit the saw system to be lifted from the tracks. For example, a coupler (57) may be used. See FIG. 1. This coupler is designed to work with moving equipment, such as front end loaders, to permit the easy and quick movement of the entire system. One preferred embodiment would use an ACS female quick coupler in conjunction with a male coupler which is fixed to a front end loader. These types of couplers are standard equipment well known in the industry.

The coupler (57) is connected to a steel structure (66) which supports the system (10) and also forms the floor of the support base. This steel structure is the top portion of the support base. All of the elements above this steel structure, including the saw unit raising and lowering system (16) and the electrical and hydraulic systems (not shown) are secured to or supported by this steel structure. By attaching the coupler directly to the steel structure, the majority of the load is being picked up directly, thus removing the strain from the lower portion of the support base.

There is also attached and secured to the support base various conventional electrical and hydraulic systems (not shown). For example, when a hydraulic system is used to run the saw unit, the hydraulic power system and electric motors that drives the hydraulic pump are secured to the support base. The electrical motor driving the hydraulic pump can be conventional, such as a standard TEFC electric motor. The hydraulic pump can also be conventional such as one manufactured by Rexroth. The hydraulic pump is attached by conventional hoses through various connecting system to the saw unit itself which cuts the stone. These elements are conventional and are well known in the industry.

In addition, there are connected to the support base various electrical systems with switches and levers to control the overall operation of the system (not shown). They are wired in conventional manner and are preferably secured within one control lever box (68) that is conveniently located for operation by the worker who is using the device. These items are preferably contained within water/moisture tight enclosures to make maintenance easier. All switches and controls are conventional and can be purchased, for example, from Allen Bradley, Inc. These control lever box also can contain the control systems for the various hydraulic systems which drive the saw unit (20) and other elements of the device. Among the systems controlled by these control systems are the hydraulic motors for speed and direction control, the travel system for speed and direction control, the raising and lowering system, the blade rotation system, the saw pivot and the engagement or disengagement of the track system.

Also connected to the support base will be the electrical mounting box (64). This box will contain the coupling connections for attachment to the electrical supply system which is generally a conventional generator type. Preferably the mountings to this box are quick connect/disconnect electrical plugs to permit ease of attachment and disconnection. From this box the electrical power is supplied to the rest of the components of the device.

Also secured to and supported by the support base is the saw unit raising and lowering system (16). The saw unit raising and lowering system (16) is secured to the support base and, preferably, to a mast support (70). The saw unit raising and lowering system is comprised generally of three elements: the first stage (72), second stage (74) and third stage (76).

The first stage (72) is basically a support structure. The first stage has a front bar support (78) on each side of the support base and wrapped around, a generally c-shaped support structure (80). See FIGS. 1, 2, 3 and 9. This support structure provides stability and structural soundness, not only supporting the rest of the saw unit raising and lowering system but also the saw unit itself. Further, this support structure prevents the second and third stage from twisting with any shifting of load. The first stage is secured to the support base by a conventional means such as by welding, bolting or other such conventional securing procedures, and preferably by bolting the support base.

Figure 10:
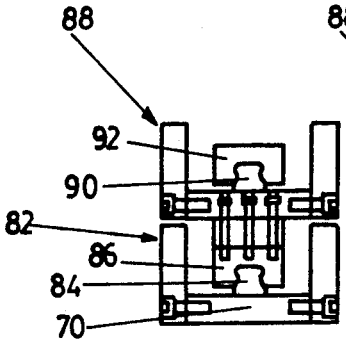
FIG. 10 is a top view of the stage one and stage two linear tracking systems.
Figure 11:
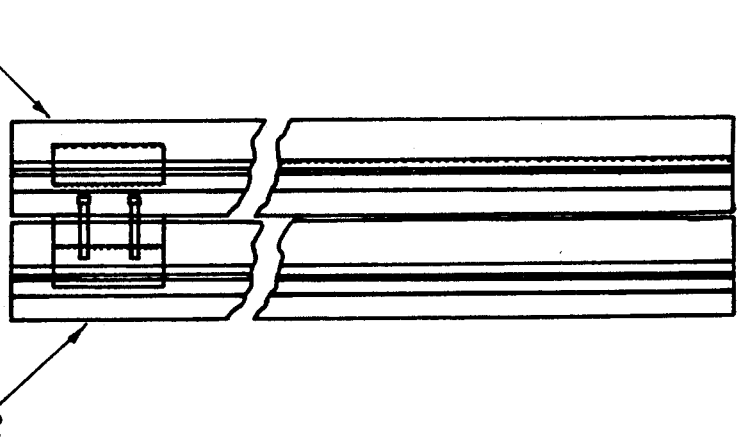
FIG. 11 is a side view of the linear tracking system.

Attached to the front bars (78) of the first stage are carriage units (82) which permit the second stage to move up and down. While many types of support system permit such vertical movement, the preferred system uses a carriage and linear tracking rail system manufactured, for example, by Schneeberger. See FIGS. 9, 10 and 11. These carriage units (82) are comprised of a linear tracking rail (84) secured to the mast support (70). A carriage (86) runs on this linear tracking rail and is secured to the element to be raised. In a preferred embodiment, a second carriage unit (88) comprised of a second linear tracking rail (90) and a second carriage (92) is secured to the first carriage. This second carriage unit is an element of the second stage, which will be discussed in more detail later.

The second stage is comprised of a support structure (94), a ball screw system (96) for moving the structure up and down, a motor system (98) for rotation of the screw system, and the second carriage unit (88) which interacts with the stage one linear tracking rail (84) to move the third stage. The second stage support (94) is similar in purpose to the first stage support system except it is not secured to the support base. The second stage moves up and down the first stage on the linear tracking rails (84). To provide stability and structural integrity to the second stage, each side of the second stage is connected together by a c-shaped support system (100). See FIG. 9. This c-shaped support structure (100) also provides support for stage two and stage three and prevents the load from shifting during use.

Figure 12:
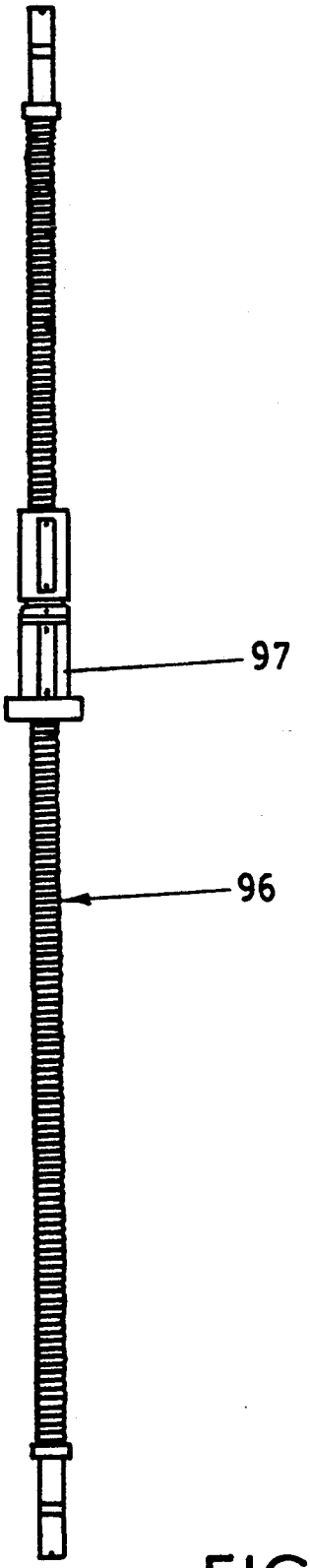
FIG. 12 is a side view of the ball screw system.

Adjacent to and interacting with the stage one linear tracking rail (54) is the stage two carriage (92) which moves up and down on the stage one linear tracking rail (84). The stage two carriage (88) is moved upwards and downwards by use of any conventional mechanism but it has been determined that the preferable means is the ball screw system (96). See FIG. 12. The ball screw system is fixed at both the top and bottom of the stage one support. When this ball screw system is driven, a plate (97) which is attached to the screw system is moved up and down. This plate is secured to the stage two tracking rails (90), thus moving stage two upwards and downwards.

Stage three operates in a similar fashion to stage two. Stage three is attached inside of stage one and stage two but is secured to the stage two linear tracking rails. See FIG. 9 The main function of the stage three is to support the saw unit (20). Both sides (102, 104) of stage three also have supports which enclose or hold stage three carriages which operate up and down the stage two linear tracking rails. See FIG. 10. The stage three support is driven by a ball screw system (106) similar to the stage two ball screw system (96). Again attached to the stage three ball screw is a plate (not shown) which is secured to the structure of the stage three tracking rails thus moving stage three upwards and downwards.

The ball screw systems (96, 106) can be of any conventional height, but preferably, are at least ten feet tall. They are conventional ball screws manufactured, for example, by Nook. This height permits the saw unit to be raised a maximum of 20 feet at the full extension of both the stage two and stage three ball screw systems. This also permits precise height adjustments at anywhere between 0 feet and 20 feet. Other heights may be used if properly stabilized within the structure of the saw system.

Figure 13:
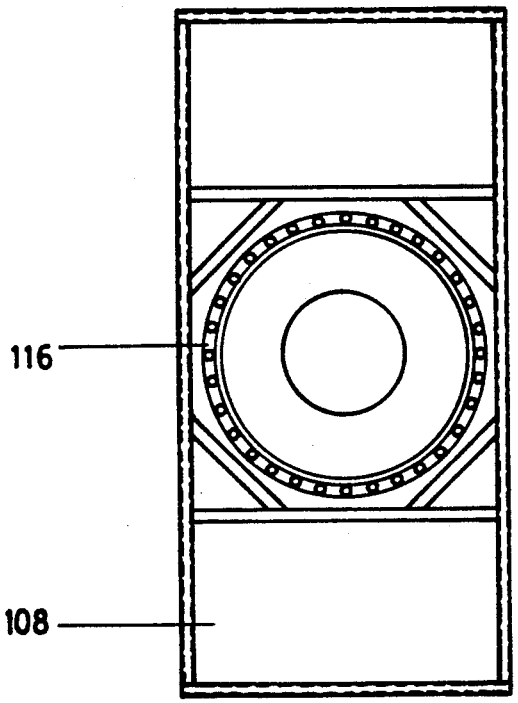
FIG. 13 is a front view of the ring gear system attached to Plate A.
Figure 14:
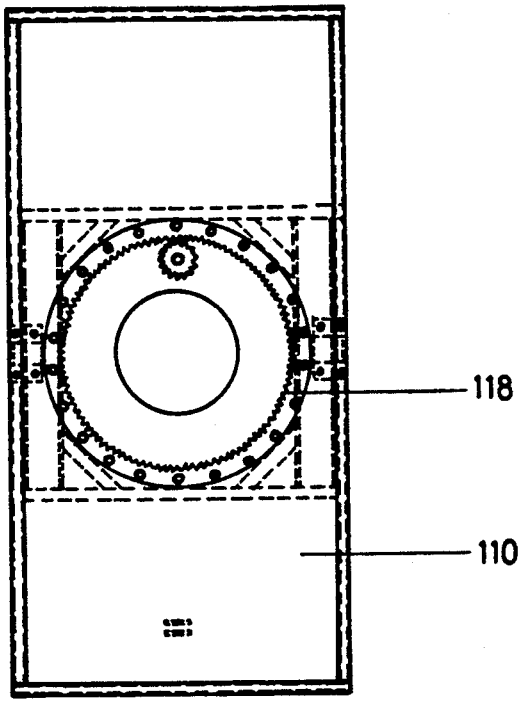
FIG. 14 is a rear view of the ring gear system attached to Plate B.
Figure 15:
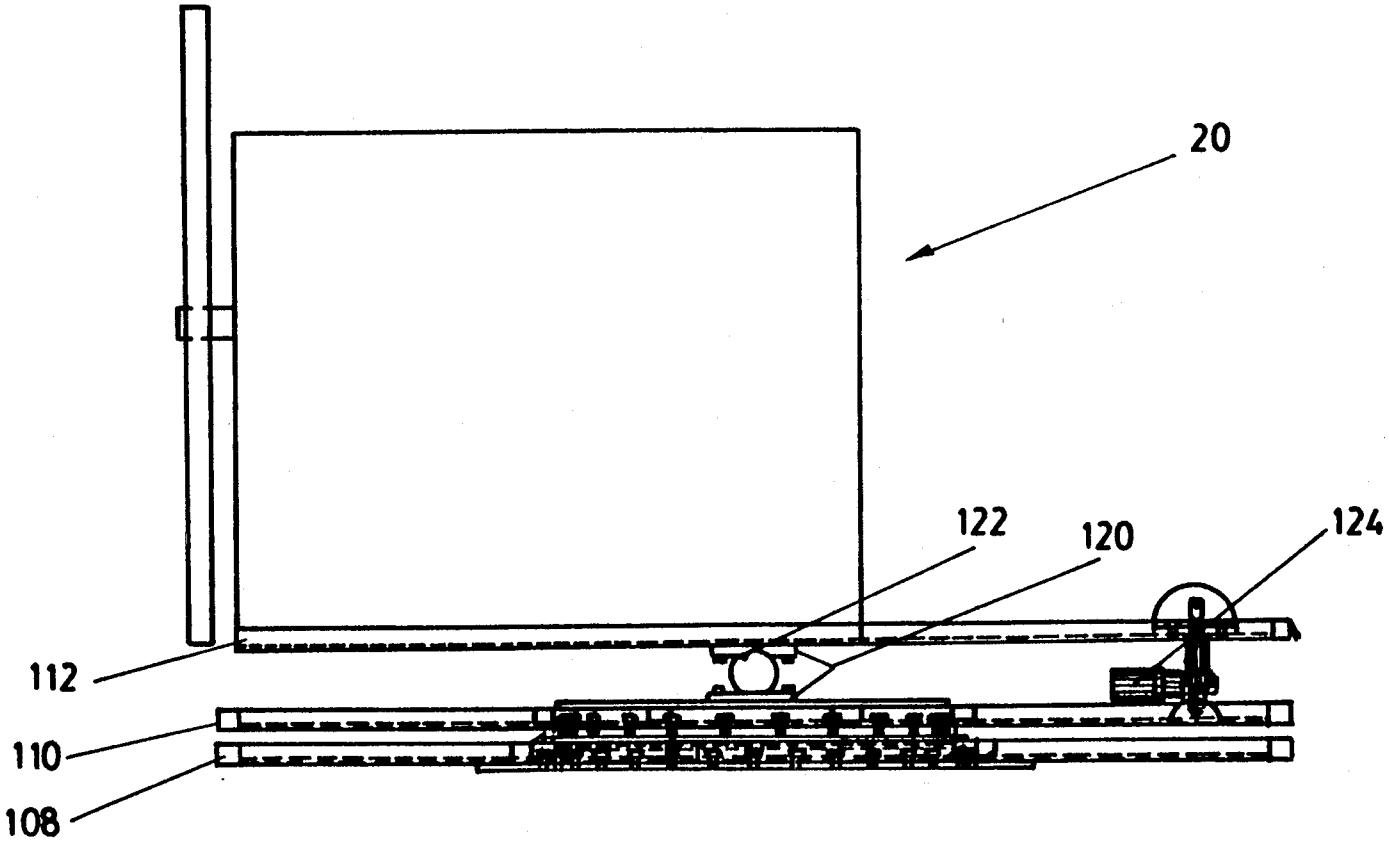
FIG. 15 is a top view showing Plates A, B and C and the saw unit.

The saw unit contains three plates which support and hold the saw system itself. The three plates, plate A (108), plate B (110) and plate C (112) provide the mechanism which permits 360° rotation of the entire saw unit as well as fine adjustments to the saw unit at various angles away from the surface of plates A and B. See FIGS. 13, 14 and 15. Each of the plates are comprised of a rectangular sheet steel with tubing along the edges to provide support. These plates can be of any conventional size sufficient to support the saw unit and, preferably, are at least about 4 feet in width and about 8 feet in length.

Plate A is secured to stage three by conventional means such as by bolts or welding, and preferably by bolts secured to the support sides (102, 104) of stage three. See FIG. 9. Plate B is secured to and operates in conjunction with Plate A. Between Plates A and B and an element of Plates A and B is a system to permit plate B to rotate 360°. Although various systems exist to permit such rotation, the preferred system is a ring gear system (114). See FIGS. 13 and 14. For example, secured to plate A is the inner race (116) of the ring gear (114) and to plate B is the outer race (118) of the ring gear. For example, this ring gear can be a Rotek Series 2100 Econo-track bearing with ring gear. The ring gear (114) is driven by a conventional pinion gear system (not shown) secured to stage three. There is also preferably an electric brake (not shown) installed on the pinion gear in association with the ring gear to prevent unwanted movement. The power unit which drives the ring gear and brake is secured to stage three. The ring gear (114) is mounted on a shaft which goes to the ring gear power unit which is mounted to the carriage support. Operation of this ring gear allows the saw unit to be rotated from a position where the saw blade is parallel with the floor of an underground gallery to any position vertical to the floor, and with further rotation to a position parallel with the ceiling. Further, because of the arrangement of the saw blade (which will be discussed in more detail later) the saw may be placed virtually flat on the ground or flat at the ceiling by this rotation. The saw blade may also be rotated to 90° of either one of the horizontal positions to permit vertical cuts. See, for example, the positions of the saw unit disclosed in FIGS. 1 and 2. This system provides significant flexibility in operation of the device.

To provide additional flexibility in the operation of the saw system, plate C (112) is secured to plate B (110). Located between plate B and plate C are a pair of bearing assemblies (120) with a shaft (122) running between them. Mounting blocks are fixed to the shaft and mount to plate C. These mounting blocks permit plate C to rotate away from plate B. This rotation is accomplished by use of an actuator (124), a self-contained ball screw/motor combination. See FIG. 15. By use of the actuator, plate C can be rotated one way or the other to permit fine adjustments to the angle of the blade. Preferably the plate can be rotated at least about 15° by this system. This fine adjustment system allows the blade to cut slightly upward from its horizontal position when cutting at the ceiling or slightly downward from its horizontal position. This is useful in the stone cutting business in an enclosed space.

Secured to the plate C is the saw unit (20). The saw unit is comprised of the saw unit drive shaft (126), the drive sheave (128), the mounting block (130) and the blade itself (132). See FIGS. 1 and 9. These elements are conventional and can be manufactured, for example, as a unit sold by W.F. Myers.

Although various saws units can be used, preferably the saw is a W.F. Myers Saw with a sheave (130) of sufficient diameter for maximum cutting. Preferably, the sheave should have at least a 5 foot diameter and run at a speed of approximately 200 rpm. The power unit which is an element of the saw support system (126) and which drives the sheave is secured to plate C (112) and is preferably hydraulic driven. The blade (134) itself can be any type of cutting blade normally used in the stone cutting industry, preferably, a diamond tooth belt cutter produced by various manufacturers, such as W. F. Myers. The saw unit preferably is enclosed in a cover to prevent exposure to water which is used during conventional cutting procedures.

The type of saw, saw blade, sheave, and size of these elements of the saw unit can be varied, depending upon the needs and desires of the user.

In operation, track (14) is placed where desired for cutting of a stone surface. Preferably, it is placed adjacent to the face of the stone surface. Various pieces of track can be placed end to end and secured together by track bolts (34) to permit track to run along the entire face of the surface. The saw system itself is carried to the track by use of a coupler system, preferably by a front end loader containing a male coupler secured to the female coupler (57) secured to the steel structure (66) of the support base (12). The saw system is placed on the tracks (14) and the saw gear box travel assembly (40) is slid in place such that the rack gear (30) of the track interacts with the spur gear (32) of the saw gear box assembly (40). The electrical umbilical cords (not shown) are attached preferably by a quick connect system such as a Hubbel watertight quick connect to the electrical mounting boxes of the saw system. The unit is then moved along the rails of the track to the appropriate position for cutting.

Once in position the saw blade (134) of the saw unit (20) is moved to its appropriate position. The saw blade is rotated by means of the ring gear system (114) of plates A (108) and B (11). The blade may be placed vertical or horizontal or at any angle in between. It may be placed such that it is virtually parallel to the floor of the gallery or virtually parallel to the ceiling of the gallery. The saw blade may also be pivoted by the actuator (124) located between plates B (110) and C (112) to permit fine adjustments to the angle of the blade. Once the blade is in position, it makes its entry cut. The blade may cut to heights upwards of at least 20 feet. This height is achieved by operations of the first stage (74), the second stage (76) and the third stage (78). The second stage (76) is raised by operation of the first ball screw system (96) which functions between the first stage and the second stage to move the carriage (92) of the second stage upwards along the rail (84) of the first stage. This permits the saw unit to be raised on the first stage to the full height of stage one, which preferably is at least 10 feet. By similar operation, the third stage can raise the second stage (74) at least an additional 10 feet. This permits the maximum height assuming the carriage rails and the ball screws are at least 10 feet to be raised at least 20 feet.

When the saw is in operation cutting in a vertical position, the saw unit is raised or preferably lowered in the cutting operation by raising or lowering the appropriate stage. For example, if the blade is extended, the third stage (76) is lowered as the cutting process occurs by rotation of the stage three ball screw (106). The cutting can be done at any speed desired by control of the movement of the ball screw.

In a similar fashion, when horizontal cuts are being made once the saw is in place within the stone, the entire unit can be moved along the track (14) at whatever speed is appropriate to permit efficient and accurate cutting. Thus, by the combination of the vertical and horizontal cutting, large numbers of blocks of stone can be cut precisely, accurately and quickly.

This method of movement of the saw and rotation of the saw blade allows for a continuous cutting along a long surface, both vertically and horizontally, at many different angles. Once the sawing is complete on an entire face, the saw gear box assembly (62) is slid away, the electrical connections uncoupled and the quick coupler system is disconnected so that the gallery say unit (10) can be moved to a new location.

What is claimed is:

1. An underground gallery saw system comprised of:
(a) a track system;
(b) a mainframe with means for powered movement of said mainframe along said track wherein said means for powered movement is secured to the mainframe;
(c) a height adjustment system secured to said mainframe;
(d) a saw unit containing a saw blade system secured to the height adjustment system by a powered rotation means which permits controlled circumferential rotation of the saw blade system throughout 360° of rotational adjustment; and
(e) a drive unit secured to said mainframe.

2. The underground gallery saw system of claim 1 wherein the mainframe contains a storage system for the storage of a counterweight.

3. The underground gallery saw system of claim 1 wherein the drive unit contains electrical and hydraulic systems for driving the means for movement of the mainframe along the track, the height adjustment system and the saw unit.

4. The underground gallery saw system of claim 1 wherein the powered rotation means is comprised of a pair of plates secured together by a rotator means permitting one plate to circumferentially rotate about the other plate.

5. The underground gallery saw system of claim 4 wherein the rotator means for circumferential rotation is a ring gear.

6. The underground gallery saw system of claim 4 wherein the saw unit includes a pivot means which permits the saw blade system to pivot at least about 15 degrees.

7. The underground gallery saw system of claim 6 wherein the pivot means is a third plate secured to the pair of plates by a pivot bearing assembly containing an actuator for pivoting of the third plate.

8. The underground gallery saw system of claim 1 wherein the height adjustment system is comprised of a first means of vertical adjustment, a second means of vertical adjustment and a third means of vertical adjustment.

9. The underground gallery saw system of claim 1 wherein the first means of vertical adjustment is secured to the mainframe and is comprised of a front bar support, a generally c-shaped support structure, and a carriage and linear tracking rail system.

10. The underground gallery saw system of claim 8 wherein the second means of vertical adjustment is comprised of a support structure, a first ball screw system, a motor system for moving the first ball screw system and a carriage and linear tracking rail system.

11. The underground gallery saw system of claim 8 wherein the third means of vertical adjustment is comprised of a support structure and a second ball screw system.

12. The underground gallery saw system of claim 1 wherein the track system is comprised of I-shaped rails secured together by support bars and secured thereto is a rack gear.

13. The underground gallery saw system of claim 12 wherein the means for moving the mainframe along the track is a saw gear box travel assembly wherein the saw gear box assembly is secured to the mainframe and operates a spur or pinion gear to move the mainframe along the track by interaction with the rack gear.

14. An underground gallery saw system comprised of (a) a track system;

(b) a mainframe with means for powered movement of said mainframe along said track wherein said means for powered movement is secured to the mainframe;

(c) a height adjustment system secured to the mainframe comprised of a first means of vertical adjustment, a second means of vertical adjustment and a third means of vertical adjustment;

(d) a saw unit containing a saw blade system secured to the height adjustment system by a powered rotation means wherein said rotation means is comprised of a pair of plates secured together by a rotator means permitting one plate to circumferentially rotate about the other plate through 90° of rotational adjustment; and (e) a power drive unit secured to said mainframe.

15. The underground gallery saw system of claim 14 wherein the saw unit includes a pivot means which permits the saw blade system to pivot at least about 15 degrees.

16. The underground gallery saw system of claim 15 wherein the pivot means is a third plate secured to the pair of plates by a pivot bearing assembly which includes an actuator to pivot the third plate.

17. The underground gallery saw system of claim 14 wherein the track is comprised of I-shaped rails secured together by support bars and a rack gear.

18. An underground gallery saw system comprised of (a) a track system comprised of rails secured together by support bars and a rack gear;

(b) a mainframe containing a saw gear box travel assembly which operates a pinion or a spur pinion gear to move the mainframe along the tracks by means of the rack gear;

(c) a height adjustment system secured to the mainframe comprised of a first stage, a second stage and a third stage;

(d) a saw unit containing a saw blade system secured to the height adjustment system by a pair of plates secured together by a ring gear which permits one plate to circumferentially rotate about the other plate wherein said saw unit also contains a pivot means which permits the saw blade system to pivot at least about 15°; and (e) a power drive unit secured to said mainframe.

19. The underground gallery saw system of claim 18 wherein the pivot means is a third plate secured to the pair of plates by a pivot bearing assembly containing an actuator for pivoting of the third plate.

20. The underground gallery saw system of claim 18 wherein the first stage is comprised of a front bar support, a generally c-shaped support structure and a carriage and linear tracking rail system; the second stage is comprised of a support structure, a first ball screw system, a motor system for moving the first ball screw system, and a carriage and linear tracking rail system; and the third stage is comprised of a support structure and a second ball screw system.

* * * * *